US006691321B1

(12) United States Patent
Matut

(10) Patent No.: US 6,691,321 B1
(45) Date of Patent: Feb. 17, 2004

(54) WEIGHT LIFTING OR EXERCISE GLOVE WITHOUT FINGER STALLS

(76) Inventor: Jeffrey Matut, 1208 Rte. 34, Aberdeen, NJ (US) 07747

( * ) Notice: Subject to any disclaimer, the term of this patent is extended or adjusted under 35 U.S.C. 154(b) by 0 days.

(21) Appl. No.: 10/191,868

(22) Filed: Jul. 10, 2002

(51) Int. Cl.[7] ..... A41D 19/00
(52) U.S. Cl. ..... 2/161.1; 2/158
(58) Field of Search ..... 2/158, 16, 20, 2/21, 160, 161.1, 161.3, 163; 294/25; 482/44, 49, 50

(56) References Cited

U.S. PATENT DOCUMENTS 482,647 A * 9/1892 Obear ..... 2/158
1,402,799 A * 1/1922 Ryan ..... 473/518
1,868,822 A * 7/1932 Goldkind ..... 2/20
2,645,778 A * 7/1953 Probert ..... 2/158
5,509,143 A * 4/1996 Yates et al. ..... 2/160

* cited by examiner

*Primary Examiner*—John J. Calvert
*Assistant Examiner*—Katherine Moran
(74) *Attorney, Agent, or Firm*—Ezra Sutton

(57) ABSTRACT

The present invention provides an exercise glove to be worn during weight lifting or exercise comprising a hand section extending between the wrist and the base of the fingers when worn on the user's hand. The hand section has a palm section for covering the user's palm. The hand section also extends around the hand and has a thumb hole through which the thumb extends and a single finger opening through which the remaining four (4) fingers extend freely without restriction as to movement. The palm section has a gripping section extending from the palm section. The gripping section forms a flap for covering and protecting the palm side of the user's four (4) fingers during exercise that uses the fingers for gripping.

4 Claims, 2 Drawing Sheets

WEIGHT LIFTING OR EXERCISE GLOVE WITHOUT FINGER STALLS

FIELD OF INVENTION

The present invention relates to an improved weight lifting or exercise glove without finger stalls, but having a flap which engages and protects the palm side of the hand and fingers during weight lifting or exercise.

BACKGROUND OF THE INVENTION

Common weight lifting or athletic fingerless gloves provide adequate protection to the palm and the lower portion of the fingers by enclosing the palm and the fingers down to the first or second joint. However, enclosing the hand and lower portions of the fingers during weight lifting or exercise often leads to increased perspiration. Such increased perspiration may cause the glove to become loose and begin to rub against the user's hand which may lead to irritation or even blisters. There is a need for a comfortable weight lifting or exercise glove that lacks finger stalls, thus avoiding encasing the user's lower fingers and avoiding increased perspiration normally associated with current fingerless gloves.

It is an object of the present invention to provide improved weight lifting or exercise gloves without finger stalls, but having a flap which engages and protects the palm and fingers during weight lifting or exercise.

It is a further object of the present invention to provide an improved weight lifting or exercise glove that reduces both hand perspiration and restriction of movement of the lower portion of the fingers, as well as providing protection for the entire palm side of the user's hands including the full length of the user's four (4) fingers during weight lifting or exercise.

DESCRIPTION OF PRIOR ART

U.S. Pat. No. 4,164,043 issued to SATORU discloses a fingerless glove for use in sports games particularly those in which rackets are used. The glove is characterized by comprising four (4) finger stalls spaced from each other by tabs and projecting from the upper edge of the palm portion of the glove, so as to define and form finger-insertion bores.

U.S. Pat. No. 5,335,916 issued to NEE discloses a fingerless palm glove used in a game of catch including a hand wrap for covering the palm of the wearer while allowing free movement of the digits and having a hook material section for use in association with a ball covered in a loop material.

SUMMARY OF THE INVENTION

The present invention provides an exercise glove to be worn during weight lifting or exercise comprising a hand section extending between the wrist and the base of the fingers when worn on the user's hand. The hand section has a palm section for covering the user's palm. The hand section also extends around the hand and has a thumb hole through which the thumb extends and a single finger opening through which the remaining four (4) fingers extend freely without restriction as to movement. The palm section has a gripping section extending from the palm section. The gripping section forms a flap for covering and protecting the palm side of the user's four (4) fingers during exercise that uses the fingers for gripping.

DETAILED DESCRIPTION OF THE PREFERRED EMBODIMENTS

Figure 1:
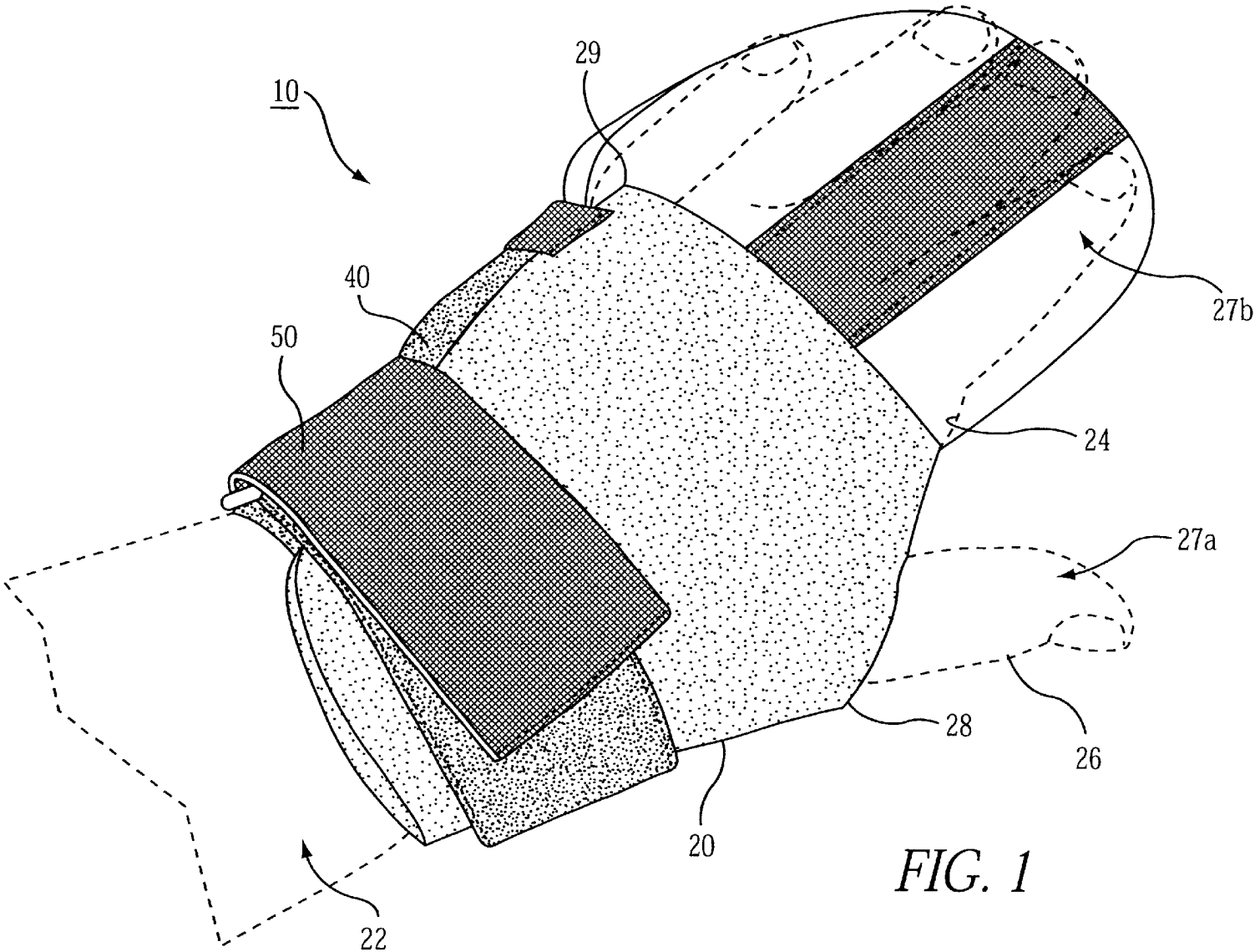
FIG. 1 is a perspective view of an improved exercise glove with the user's fingers (shown in dotted) resting on top of and engaging the flap of the glove.
Figure 2:
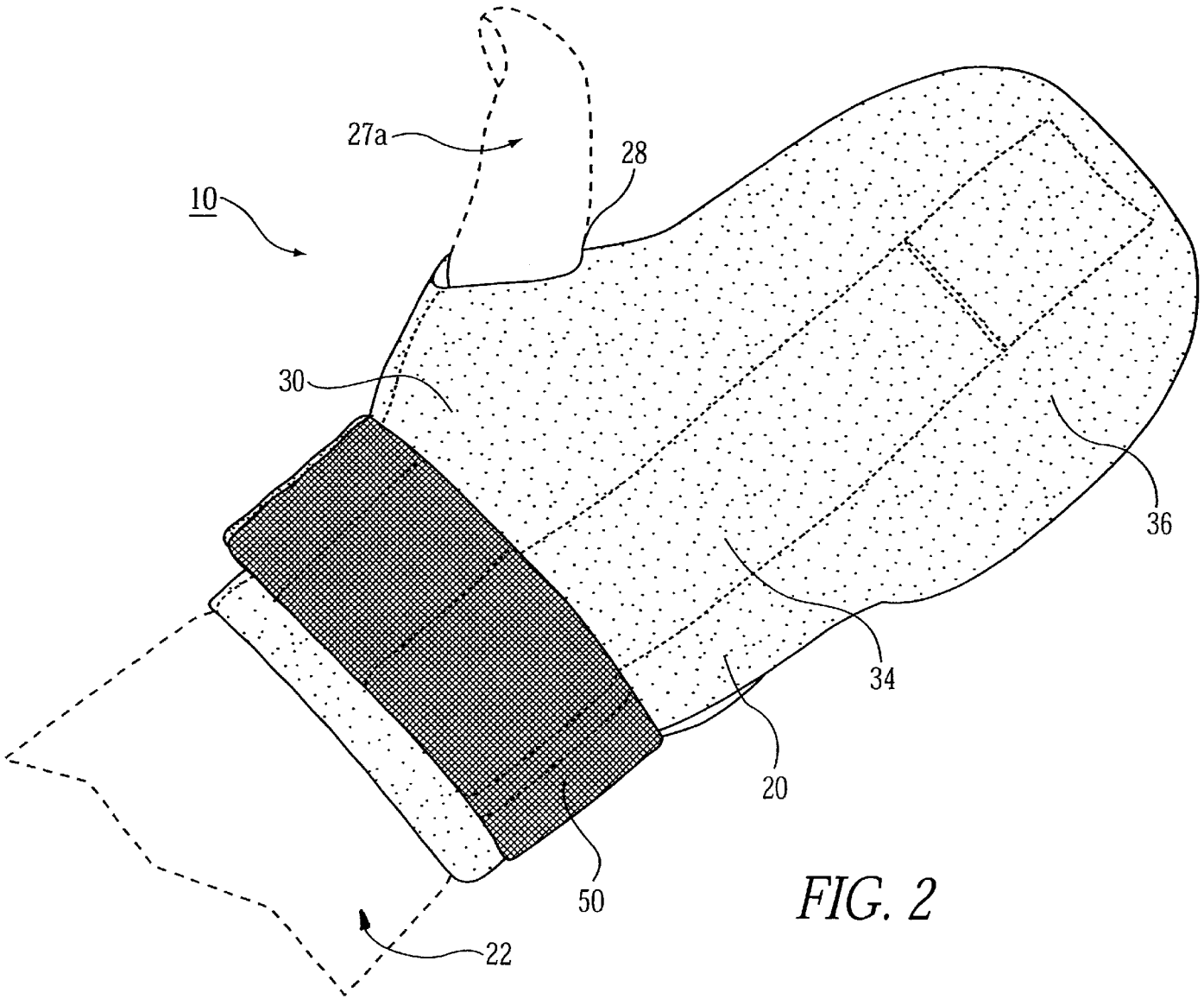
FIG. 2 is another perspective view of the palm side of the exercise glove.

FIGS. 1 and 2 show an improved exercise glove 10 to be worn during exercise, comprising a hand section 20 extending between the wrist 22 and the base of the fingers 24 when worn on the user's hand 26. The hand section 20 has a palm section 30 for covering the user's palm 32. The hand section 20 also extends around the hand 26 and has a thumb hole 28 through which the thumb 27*a* extends and a single finger opening 29 through which the remaining four (4) fingers 27*b* extend freely without restriction as to movement. The palm section 30 has a gripping section 34 extending from the palm section 30. The gripping section 34 forms a flap 36 for covering and protecting the palm side of the user's four (4) fingers 27*b* during exercise that uses the four (4) fingers for gripping. The hand section 20 is formed of elastic material and includes a strip 40 of elastic material for tightly fitting different sized hands. Also the hand section 20 includes a wrist strap 50 for tightening hand section 20 on the user's hand 26. The palm section 30 and gripping section 34 are integrally formed from a single piece of fabric wherein the gripping section 34 forms a movable flap 36 movable relative to the hand section 20.

ADVANTAGES OF THE PRESENT INVENTION

It is an advantage of the present invention to provide improved weight lifting or exercise gloves without finger stalls, but having a flap which engages and protects the palm and fingers during weight lifting or exercise.

It is a further advantage of the present invention to provide an improved weight lifting or exercise glove that reduces both hand perspiration and restriction of movement of the lower portion of the fingers, as well as providing protection for the entire palm side of the user's hands including the full length of the user's four (4) fingers during weight lifting or exercise.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An exercise glove to be worn during exercise, comprising:

a) a hand section extending between the wrist and the base of the fingers when worn on the user's hand; said hand section having a palm section for covering the user's palm;

b) said hand section extending around the hand and having a thumb hole through which the thumb extends and a single finger opening through which the remaining four fingers extend freely without restriction as to movement;

c) said palm section having a gripping section extending from said palm section; said gripping section forming a flap for covering and protecting the palm side of the user's four fingers during exercise that uses the fingers for gripping; and d) said palm section and said gripping section are integrally formed from a single piece of fabric and wherein said gripping section forms a movable flap movable relative to said hand section.

2. An exercise glove in accordance with claim 1, wherein said hand section is formed of an elastic material.

3. An exercise glove in accordance with claim 1, wherein said hand section includes a strip of elastic material for tightly fitting different size hands.

4. An exercise glove in accordance with claim 1, wherein said hand section includes a wrist strap for tightening said hand section on the user's hand.

* * * * *